US010096886B2

(12) United States Patent
Xu et al.

(10) Patent No.: US 10,096,886 B2
(45) Date of Patent: Oct. 9, 2018

(54) ANTENNA ALIGNMENT METHOD AND DEVICE

(71) Applicant: Huawei Technologies Co., Ltd., Shenzhen (CN)

(72) Inventors: Minghui Xu, Shenzhen (CN); Lingwen Xiao, Shenzhen (CN); Jia He, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 237 days.

(21) Appl. No.: 14/950,831

(22) Filed: Nov. 24, 2015

(65) Prior Publication Data

US 2016/0079651 A1 Mar. 17, 2016

Related U.S. Application Data

(63) Continuation of application No. PCT/CN2013/085440, filed on Oct. 18, 2013.

(30) Foreign Application Priority Data

May 29, 2013 (CN) ..... 2013 1 0207305

(51) Int. Cl.
*H01Q 1/12* (2006.01)

(52) U.S. Cl.
CPC ..... *H01Q 1/1257* (2013.01)

(58) Field of Classification Search
CPC ..... H01Q 1/1257
USPC ..... 342/359
See application file for complete search history.

(56) References Cited

U.S. PATENT DOCUMENTS 5,697,050 A * 12/1997 Wiedeman ..... B64G 1/24 342/354
5,818,385 A * 10/1998 Bartholomew ..... H01Q 1/246 342/372
6,380,910 B1 4/2002 Moustakas et al.
8,849,288 B2 * 9/2014 Vilhar ..... G01R 29/10 455/226.1
8,957,811 B2 * 2/2015 Davis ..... H04W 16/18 342/360
2010/0045529 A1 2/2010 Shimizu et al.

FOREIGN PATENT DOCUMENTS

CN 102111844 A 6/2011
CN 102955150 A 3/2013
EP 1783516 B1 2/2010

* cited by examiner

*Primary Examiner* — Frank J McGue
(74) *Attorney, Agent, or Firm* — Leydig, Voit & Mayer, Ltd.

(57) ABSTRACT

The present disclosure provides an antenna alignment method and device. The method comprises: according to an antenna type of an antenna and a pre-selected image element type, acquiring a standard feature image corresponding to the antenna type and the image element type from a feature image library; according to the standard feature image, determining an actual feature image of the antenna to be adjusted, wherein there is a correlation between the position of a main lobe in the standard feature image and an alignment direction of a main lobe in the actual feature image; and according to the position of the main lobe, determining the alignment direction of the main lobe in the actual feature image, and adjusting the antenna to be adjusted to the alignment direction of the main lobe in the actual feature image.

10 Claims, 7 Drawing Sheets

ANTENNA ALIGNMENT METHOD AND DEVICE

CROSS-REFERENCE TO RELATED APPLICATIONS

This application is a continuation of International Patent Application No. PCT/CN2013/085440, filed on Oct. 18, 2013, which claims priority to Chinese Patent Application No. 201310207305.5, filed on May 29, 2013, both of which are hereby incorporated by reference in their entireties.

FIELD

The disclosure relates to the technical field of communication technology, and in particular to an antenna alignment method and device.

BACKGROUND

In a microwave system, in a case that two microwave stations are going to establish a communication, antennas at both ends should be aligned with each other to ensure that a signal may be transmitted and received between two microwave stations. Antenna alignment indicates that main lobes of antennas at both ends are aligned with each other, thus the intensity of a signal received from an opposite end may reach a maximum value.

In the conventional art, a received signal strength indication (RSSI) interface is provided on an out door unit (ODU). A detection circuit within the ODU may output an RSSI voltage according to an intensity of a received signal. In the process of antenna alignment, firstly, an antenna is adjusted roughly according to latitude, longitude and altitude of the location where the antenna are located by an operator to implement preliminary antenna alignment; then the antenna is finely adjusted by the operator, where orientation of the antenna is adjusted according to a monitored RSSI voltage, and the antenna is determined in the alignment state in a case that the RSSI voltage reaches a system threshold calculated according to a RSSI form predetermined at the factory and effects of a system path and frequency.

However, the antenna alignment method according to the conventional art is complicated, and fine adjustment for an antenna is more difficult to handle by an operator and the main lobe of the antenna is difficult to be aligned.

SUMMARY

An antenna alignment method and device are provided according to the embodiments of the disclosure to improve the efficiency and accuracy of antenna alignment.

In a first aspect, an antenna alignment method is provided according to the embodiments of the disclosure, where the method includes:

acquiring, according to an antenna type of an antenna to be adjusted and a pre-selected image element type, a standard feature image corresponding to the antenna type and the image element type from a feature image library, where the image element type is a feature attribute of data points in a Received Signal Level RSL curved surface or a radiation pattern of the antenna;

determining an actual feature image of the antenna to be adjusted according to the standard feature image, where there is a correspondence between a position of a main lobe in the standard feature image and an alignment direction of a main lobe in the actual feature image; and determining the alignment direction of the main lobe in the actual feature image according to the position of the main lobe in the standard feature image and the correspondence between the position of the main lobe in the standard feature image and the alignment direction of the main lobe in the actual feature image, and adjusting the antenna to the alignment direction of the main lobe in the actual feature image.

In conjunction with the first aspect, in a first possible implementation of the first aspect, before determining the actual feature image of the antenna to be adjusted according to the standard feature image, the method may further include:

acquiring the RSL curved surface of the antenna to be adjusted; and determining the actual feature image of the antenna to be adjusted according to the standard feature image may include:

determining the actual feature image of the antenna to be adjusted according to the standard feature image, the RSL curved surface and the image element type.

In conjunction with the first possible implementation of the first aspect, in a second possible implementation of the first aspect, determining the actual feature image of the antenna to be adjusted according to the standard feature image, the RSL curved surface and the image element type may include:

determining a standard starting image element point and a state transition matrix of the actual feature image according to the standard feature image, where the state transition matrix is used to predict a trajectory of image element points of the actual feature image; and determining the actual feature image of the antenna to be adjusted according to an image element points of the image element type in the RSL curved surface, the standard starting image element point, and the state transition matrix.

In conjunction with the second possible implementation of the first aspect, in a third possible implementation of the first aspect, determining the actual feature image of the antenna to be adjusted according to the image element points of the image element type in the RSL curved surface, the standard starting image element points, and the state transition matrix may include:

extracting initial image element points of the image element type in the RSL curved surface, and determining an actual starting image element point of the actual feature image according to the initial image element points and the standard starting image element points;

predicting a trajectory of standard image element points of the actual feature image according to the state transition matrix, and extracting trajectory image element points of the image element type in the RSL curved surface according to the trajectory of the standard image element points;

determining a trajectory of actual image element points according to the trajectory image element points; and determining the actual feature image of the antenna to be adjusted according to the starting image element point and the trajectory of the actual image element points.

In conjunction with the third possible implementation of the first aspect, in a fourth possible implementation of the first aspect, determining the actual starting image element point of the actual feature image according to the initial image element points and the standard starting image element point may include:

acquiring an initial point space between two neighboring initial image element points in a preset order, and acquiring a standard point space between two neighboring standard starting image element points in the preset order; using the two neighboring initial image element points as the actual starting image element point of the actual feature in a case that an absolute value of a difference between the initial point space and the standard point space is less than a preset value.

In conjunction with any one of the second possible implementation to the fourth possible implementation of the first aspect, in a fifth possible implementation of the first aspect, the alignment direction of the main lobe in the actual feature image may be an intersecting point of two straight lines in the actual feature image in a case that the image element is a local maximum value and the antenna to be adjusted is a panel antenna; and the alignment direction of the main lobe in the actual feature image may be a center of concentric circles in the actual feature image in a case that the image element is a local minimum value and the antenna to be adjusted is a parabolic antenna.

In conjunction with any one of the first aspect, the first possible implementation to the fifth possible implementation of the first aspect, in a sixth possible implementation of the first aspect, before acquiring the standard feature image corresponding to the antenna type and the image element type from the feature image library according to the antenna type of the antenna to be adjusted and the pre-selected image element type, the method may further include:

acquiring a set of radiation patterns of antennas and a set of image elements, where the set of radiation patterns of the antennas includes standard radiation patterns of various types of antennas, and the set of image elements includes various types of image elements; and traversing, based on the standard radiation patterns in the set of the radiation patterns of the antenna, the image elements in the set of the image elements, extracting an image element point of the feature image corresponding to the image element type from the standard radiation pattern, using an image composed of the image element point of the feature image as the standard feature image corresponding to the antenna type of the antenna to which the standard radiation pattern belongs and the image element type, and storing the standard feature image to the feature image library.

In a second aspect, an antenna alignment device is provided according to the embodiments of the disclosure, where the device includes:

a selection module, configured to acquire, according to an antenna type of an antenna to be adjusted and a pre-selected image element type, a standard feature image corresponding to the antenna type and the image element type from a feature image library, where the image element type is a feature attribute of data points in a Received Signal Level RSL curved surface or a radiation pattern of the antenna;

a determination module, configured to determine an actual feature image of the antenna to be adjusted according to the standard feature image, where there is a correspondence between a position of a main lobe in the standard feature image and an alignment direction of a main lobe in the actual feature image; and an adjustment module, configured to determine the alignment direction of the main lobe in the actual feature image according to the position of the main lobe in the standard feature image and the correspondence between the position of the main lobe in the standard feature image and the alignment direction of the main lobe in the actual feature image, and adjust the antenna to the alignment direction of the main lobe in the actual feature image.

In conjunction with the second aspect, in a first possible implementation of the second aspect, the device may further include:

a curved surface acquiring module, configured to acquire the RSL curved surface of the antenna to be adjusted before the actual feature image of the antenna to be adjusted is determined according to the standard feature image;

the determination module may be further configured to determine the actual feature image of the antenna to be adjusted according to the standard feature image, the RSL curved surface and the image element type.

In conjunction with the first possible implementation of the second aspect, in a second possible implementation of the second aspect, the determining module may include:

a first determination unit, configured to determine a standard starting image element point and a state transition matrix of the actual feature image according to the standard feature image, where the state transition matrix is used to predict a trajectory of image element points of the actual feature image; and a second determining unit, configured to determine the actual feature image of the antenna to be adjusted according to image element points of the image element type in the RSL curved surface, the standard starting image element point, and the state transition matrix.

In conjunction with the second possible implementation of the second aspect, in a third possible implementation of the second aspect, the second determination unit may be further configured to:

extract initial image element points of the image element type in the RSL curved surface, and determine an actual starting image element point of the actual feature image according to the initial image element points and the standard starting image element points;

predict a trajectory of standard image element points of the actual feature image according to the state transition matrix, and extract a trajectory image element points of the image element type in the RSL curved surface according to the trajectory of the standard image element points;

determine a trajectory of actual image element points according to the trajectory image element points; and determine the actual feature image of the antenna to be adjusted according to the starting image element point and the trajectory of the actual image element points.

In conjunction with the third possible implementation of the second aspect, in a fourth possible implementation of the second aspect, the second determination unit may be further configured to:

acquire an initial point space between two neighboring initial image element points in a preset order, and acquire a standard point space between two neighboring standard starting image element points in the preset order; use the two neighboring initial image element points as the actual starting image element point of the actual feature in a case that an absolute value of a difference between the initial point space and the standard point space is less than a preset value.

In conjunction with any one of the second possible implementation to the fourth possible implementation of the second aspect, in a fifth possible implementation of the second aspect, the alignment direction of the main lobe in the actual feature image may be an intersecting point of two straight lines in the actual feature image in a case that the image element is a local maximum value and the antenna to be adjusted is a panel antenna; and the alignment direction of the main lobe in the actual feature image may be a center of concentric circles in the actual feature image in a case that the image element is a local minimum value and the antenna to be adjusted is a parabolic antenna.

In conjunction with any one of the second aspect, the first possible implementation to the fifth possible implementation of the second aspect, in a sixth possible implementation of the second aspect, the device may further include a set acquiring module and a feature image library establishing module, where the set acquiring module is configured to, before acquiring the standard feature image corresponding to the antenna type and the image element type from the feature image library according to the antenna type of the antenna to be adjusted and the pre-selected image element type, acquire a set of radiation patterns of antennas and a set of image elements, where the set of radiation patterns of the antennas includes standard radiation patterns of various types of antennas, and the set of image elements includes various types of image elements; and the feature image library establishing module is configured to traverse, based on the standard radiation patterns in the set of the radiation pattern of the antenna, the image elements in the set of the image element, extract an image element of the feature image corresponding to the image element type from the standard radiation pattern, use an image including the image element of the feature image as the standard feature image corresponding to the antenna type of the antenna to which the standard radiation pattern belongs and the image element type, and store the standard feature image to the feature image library.

An antenna alignment method and device are provided according to the embodiments of the disclosure. The method including: acquiring, according to an antenna type of an antenna to be adjusted and a pre-selected image element type, a standard feature image corresponding to the antenna type and the image element type from a feature image library; determining an actual feature image of the antenna to be adjusted according to the standard feature image; determining the alignment direction of the main lobe in the actual feature image according to the position of the main lobe in the standard feature image and the correspondence between the position of the main lobe in the standard feature image and the alignment direction of the main lobe in the actual feature image, and adjusting the antenna to be adjusted to the alignment direction of the main lobe in the actual feature image. With the method, the influences of manual operation of an operator to antenna alignment may be avoided, and the efficiency of antenna alignment may be enhanced. Furthermore, the alignment direction of the main lobe in the actual feature image is determined directly according to the position of the main lobe in the standard feature image and the correspondence between the position of the main lobe in the standard feature image and the alignment direction of the main lobe in the actual feature image, thus the accuracy and precision of antenna alignment may be improved.

BRIEF DESCRIPTION OF THE DRAWINGS

The drawings to be used in the description of the embodiments or the conventional technology will be described briefly as follows, so that the technical solutions according to the embodiments of the present disclosure or the conventional technology will become clearer. It is apparent that the drawings in the following description only illustrate some embodiments of the present disclosure. For those skilled in the art, other drawings may be obtained according to these drawings without any creative work.

DETAILED DESCRIPTION OF THE EMBODIMENTS

For the clarity of the objects, technical solutions and advantages of the disclosure, technical solutions according to embodiments of the present disclosure are described clearly and completely hereinafter in conjunction with the drawings. It is obvious that the described embodiments are only a part rather than all of the embodiments according to the present disclosure. Any other embodiments obtained by those skilled in the art based on the embodiments in the present disclosure without any creative work fall in the scope of the present disclosure.

Figure 1:
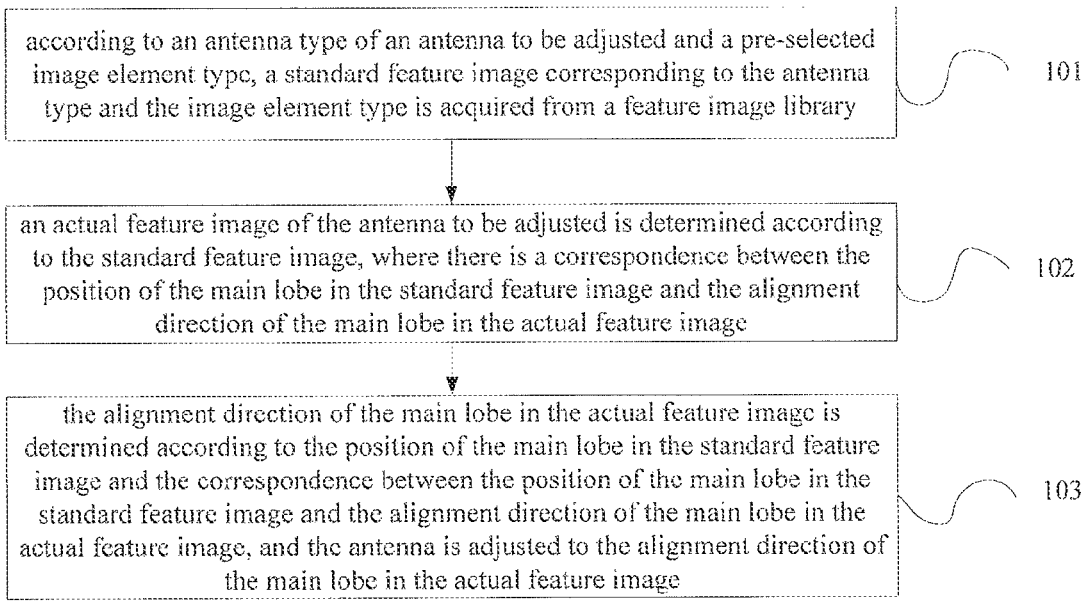
FIG. 1 is a flow chart of an antenna alignment method according to a first embodiment of the disclosure.

FIG. 1 is a flow chart of an antenna alignment method according to a first embodiment of the disclosure. An execution subject according to the present embodiment may be an antenna alignment device which may be disposed in a step motor and implemented by software and/or hardware. As shown in FIG. 1, the method according to the embodiment may include the following steps 101 to 103.

In step 101, according to an antenna type of an antenna to be adjusted and a pre-selected image element type, a standard feature image corresponding to the antenna type and the image element type is acquired from a feature image library.

Particularly, the image element type is a feature attribute of data points in a Received Signal Level RSL curved surface or a radiation pattern of the antenna.

Figure 2A:
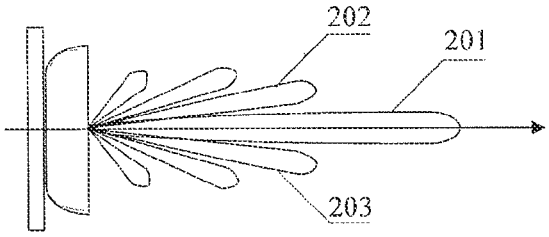
FIG. 2A is a vertical radiation pattern of an antenna according to the disclosure.
Figure 2B:
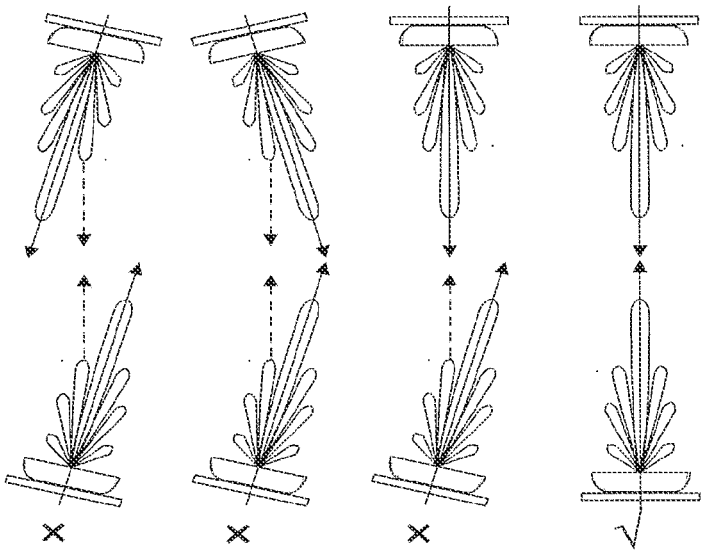
FIG. 2B is a schematic diagram of a typical situation for antenna alignment according to the disclosure.

In the specific application, the intensity of electric field generated by antenna radiation varies spatially, and the tendency of the variation is described with a radiation pattern of the antenna. The radiation pattern of the antenna includes a horizontal radiation pattern and a vertical radiation pattern. FIG. 2A is a vertical radiation pattern of an antenna according to the disclosure. As can be seen from FIG. 2A, the vertical radiation pattern includes multiple lobes, where the lobe in the direction of maximum radiation is the main lobe 201, and other lobes are side lobes. Among side lobes, it is the first side lobe, such as a first side lobe 202 and a second side lobe 202 in FIG. 2, which may affect antenna alignment. FIG. 2B is a schematic diagram of a typical situation for antenna alignment according to the disclosure. In FIG. 2B, "×" indicates misalignment of antennas and "√" indicates proper alignment of antennas. As can be seen from FIG. 2B, the antennas are properly aligned only in a case where main lobes of antennas at both ends are aligned with each other.

In the produce of antenna alignment adjustment, firstly, the main lobes of antennas are adjusted to a main lobe alignment direction which is the direction of a connecting line between the antennas at both ends. That is, the direction of a connecting line between main lobes of two antennas in a case that the main lobes of antennas at both ends are aligned with each other. The alignment adjustment procedure is repeated for 2 or 3 times until the main lobes of antennas at both ends are aligned with each other. In the present embodiment, a single procedure for adjusting the main lobe of the antenna to be adjusted to the main lobe alignment direction is taken as an example to describe the antenna alignment procedure according to the present disclosure in detail. Subsequent antenna alignment procedures are similar and descriptions thereof will be omitted in the present embodiment.

Particularly, the antenna alignment method according to the present embodiment may be used for aligning backhaul devices of a small cell, and may be used for two narrow beam antennas, and is also applicable for one narrow bean antenna and one broad beam antenna, or two broad beam antennas. Particularly, for the narrow-beam antenna, its main lobe is relatively narrow, therefore the alignment takes a long time and the main lobe alignment position can be easily missed in a case that manual alignment is adopted.

In the step 101, firstly, the image element type is pre-selected, where the image element type is a feature attribute of data points in a received signal level (Received Signal Level, abbreviated as RSL) curved surface or a radiation pattern of the antenna. The RSL curved surface is used for indicating an actual radiation direction of the antenna, and the radiation pattern of the antenna is used for indicating a theoretical radiation direction of the antenna. In the RSL curved surface and the radiation pattern of the antenna, the feature attribute of the data points in the RSL curved surface and the radiation pattern of the antenna particularly may be a local maximum value, a local minimum value, a local maximum average value or a local minimum average value, etc. Particularly, the image element type may be pre-selected according to environmental factors. In particularly, the environmental factors may include the number of antennas in the surrounding environment or the complexity of the structure of antennas in the surrounding environment. An image element type, by which an antenna may be distinguished from other antennas in the surrounding environment, the time required for aligning the antenna may be minimized and the simplest implementation of antenna alignment is achieved, may be selected for the antenna according to environmental factors. The particular procedure of pre-selection is not limited in the present embodiment. It will be understood by those skilled in the art, in the RSL curved surface and the radiation pattern of the antenna, a data point is not an image element point of the standard feature image in a case that the data point does not have the feature attribute, and the data point is the image element point of the standard feature image only in a case that the data point has the feature attribute.

Antennas to be adjusted may be classified into various types, which include a panel antenna and a parabolic antenna, according to a structure characteristic of the antenna. It will be understood by those skilled in the art, in the above, the antenna is classified only according to the structure characteristic. In the specific implementation, antennas may be classified according to a polarization degree of the antenna or an irradiation angle of the antenna, etc. The particular implementation of the antenna type is not limited in the present embodiment.

Figure 3A:
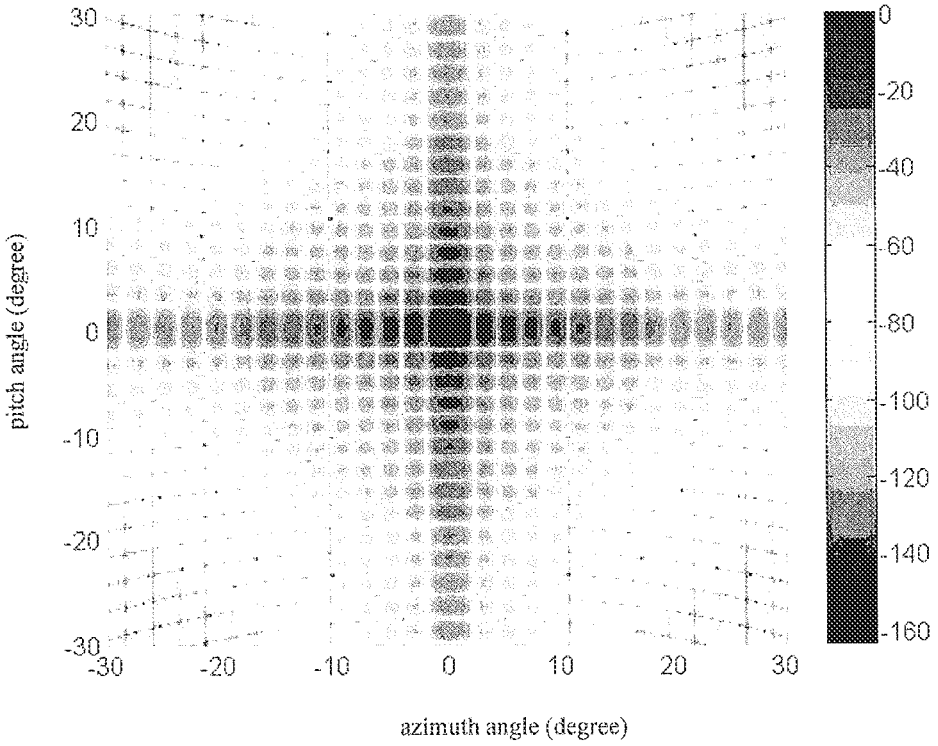
FIG. 3A is a radiation pattern of a panel antenna according to the disclosure.
Figure 3B:
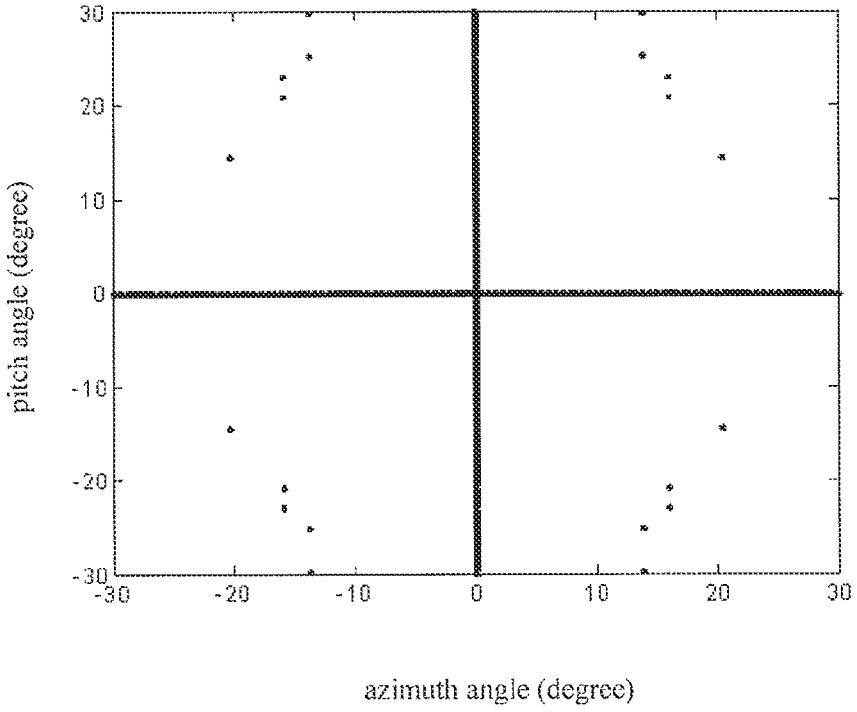
FIG. 3B is a schematic diagram of a standard feature image of the panel antenna according to the disclosure.
Figure 4:
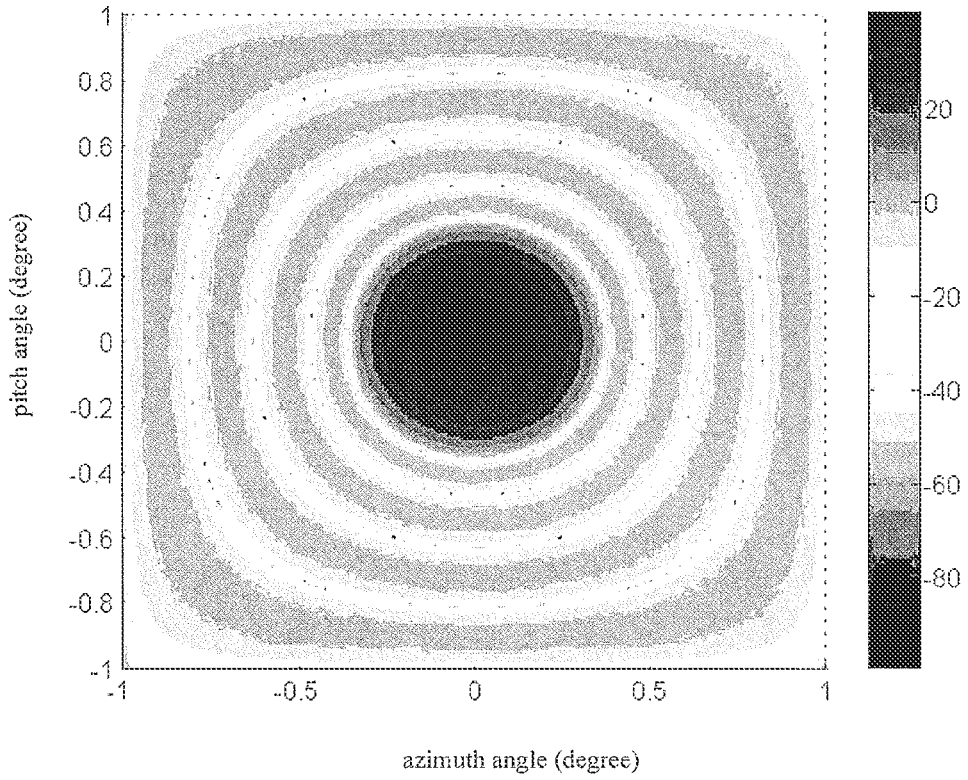
FIG. 4 is a radiation pattern of a parabolic antenna according to the disclosure.

The standard feature image in the feature image library may be determined according to the antenna type of the antenna to be adjusted and the pre-selected image element type. The feature image library includes various types of standard feature images which correspond to antenna types and the image element types. For example, in a case that the antenna is a panel antenna and the image element is the local maximum value, the standard feature image is drawn according to the local maximum value in the radiation pattern of the panel antenna, as illustrated particularly in FIG. 3A and FIG. 3B, where FIG. 3A is a radiation pattern of the panel antenna according to the disclosure, and FIG. 3B is a schematic diagram of the standard feature image of the panel antenna according to the disclosure. As shown in FIG. 3A, the horizontal coordinate indicates the azimuth angle of the antenna, the longitudinal coordinate indicates the pitch angle of the antenna. The longitudinal bar graph parallel to the longitudinal coordinate indicates gains of a level of a received signal, where different color depths represent different gains. Gains decrease successively from 0 from top to bottom of the longitudinal bar graph. As can be seen from the radiation pattern, the data points corresponding to two straight lines perpendicular to each other exhibit the darkest color, which indicates each of the points on the two straight lines perpendicular to each other is the local maximum value, and FIG. 3B is the standard feature image drawn according to the local maximum values, where a position of the main lobe in the standard feature image is an intersecting point of two straight lines in the standard feature image. As another example, in a case that the antenna is a parabolic antenna and the image element is the local minimum value, the standard feature image is drawn according to local minimum values in the radiation pattern of the parabolic antenna, as illustrated particularly in FIG. 4, which is a radiation pattern of the parabolic antenna according to the disclosure. A corresponding standard feature image is an image consisting of each of the concentric circles from FIG. 4, and the position of the main lobe in the standard feature image is the center of concentric circles in the standard feature image. The detailed description for FIG. 4 is similar to the description for FIG. 3A, and will be omitted in the present embodiment.

In step 102, an actual feature image of the antenna to be adjusted is determined according to the standard feature image, where there is a correspondence between the position of the main lobe in the standard feature image and the alignment direction of the main lobe in the actual feature image.

In the specific implementation, before step 102, the RSL curved surface of the antenna to be adjusted is acquired. In the specific operation, the antennas at both ends are activated simultaneously. The antenna at one end is fixed and the antenna to be adjusted at the other end performs a scan to acquire the RSL curved surface. In a case that the RSL curved surface can not be acquired, the angle of the antenna at the opposite end is adjusted until the RSL curved surface of the antenna to be adjusted is acquired. After the RSL curved surface is acquired, the actual feature image of the antenna to be adjusted is determined according to the standard feature image, the RSL curved surface and the image element type. Particularly, a standard starting image element point and a state transition matrix of the actual feature image are determined according to the standard feature image, and the actual feature image of the antenna to be adjusted is determined according to an image element point of the image element type in the RSL curved surface, the standard starting image element point, and the state transition matrix.

Particularly, there is a correspondence between the position of the main lobe in the standard feature image and the alignment direction of the main lobe in the actual feature image. For example, the position of the main lobe in the standard feature image is an intersecting point of two straight lines in the standard feature image in a case that the antenna is a panel antenna and the image element is a local maximum value. Correspondingly, the alignment direction of the main lobe in the actual feature image is also an intersecting point of two straight lines in the actual feature image. As another example, the position of the main lobe is the center of concentric circles in the standard feature image in a case that the antenna is a parabolic antenna and the image element is a local minimum value. Correspondingly, the alignment direction of the main lobe in the actual feature image is the center of concentric circles in the actual feature image.

In step 103, the alignment direction of the main lobe in the actual feature image is determined according to the position of the main lobe in the standard feature image and the correspondence between the position of the main lobe in the standard feature image and the alignment direction of the main lobe in the actual feature image, and the antenna is adjusted to the alignment direction of the main lobe in the actual feature image.

The alignment direction of the main lobe in the actual feature image is determined only according to the position of the main lobe in the standard feature image and the correspondence described in step 102. Particularly, due to different initial states of antenna alignment, in some cases, the obtained actual feature image can only represent a part of the standard feature image. Therefore, processes such as displacement and rotation may be performed on the standard feature image to make the standard feature image conform to the correspondence to determine the alignment direction of the main lobe, as can be seen from the description of FIG. 3B and the following FIG. 6.

When the antenna is adjusted to the alignment direction of the main lobe, a small range scan may be performed in the vicinity of the main lobe of the antenna to further determine a more accurate alignment direction of the main lobe of the antenna, thereby reducing positioning error. Then the antenna is fixed, and the antenna at the other end is informed to start perform alignment. When a signal is received by the antenna at the other end, the above steps is repeated until accurate alignment is achieved, and the antenna at this end is informed that antenna alignment is completed.

According to the antenna alignment method provided in the embodiments of the disclosure, a standard feature image corresponding to an antenna type and an image element type from a feature image library according to the antenna type of the antenna to be adjusted and the pre-selected image element type; an actual feature image of the antenna to be adjusted is determined according to the standard feature image; the alignment direction of the main lobe in the actual feature image is determined according to the position of the main lobe in the standard feature image and the correspondence between the position of the main lobe in the standard feature image and the alignment direction of the main lobe in the actual feature image, and the antenna is adjusted to the alignment direction of the main lobe in the actual feature image. With this method, the influences of manual operation of an operator to antenna alignment may be avoided, and the efficiency of antenna alignment may be enhanced. Furthermore, the alignment direction of the main lobe in the actual feature image is determined directly according to the position of the main lobe in the standard feature image and the correspondence between the position of the main lobe in the standard feature image and the alignment direction of the main lobe in the actual feature image, therefore the accuracy and precision of antenna alignment may be improved.

Figure 5:
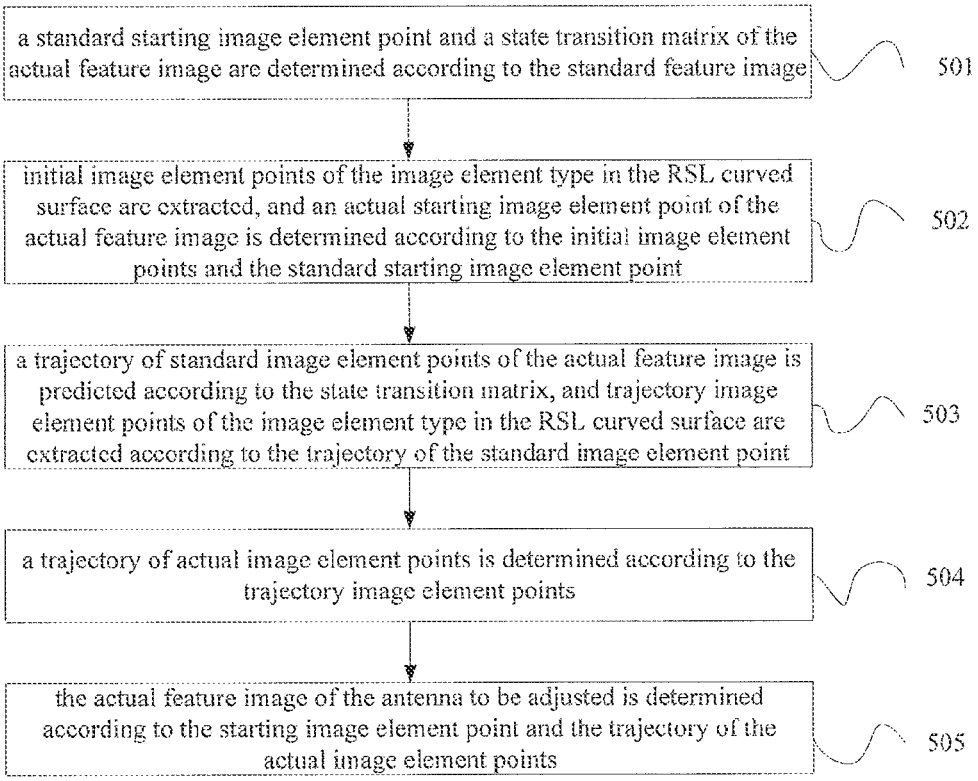
FIG. 5 is a flow chart of an process of acquiring an actual feature image according to the disclosure.

FIG. 5 is a flow chart of a procedure of obtaining an actual feature image according to the disclosure. In the present embodiment, the process of determining the actual feature image of the antenna to be adjusted according to the standard feature image, the RSL curved surface and the image element type in step 102 is described in detail based on the embodiment shown in FIG. 1. As shown in FIG. 5, the method according to the present embodiment includes the following steps 501 to 505.

In step 501, a standard starting image element point and a state transition matrix of the actual feature image are determined according to the standard feature image.

In step 502, initial image element points of the image element type in the RSL curved surface are extracted, and an actual starting image element point of the actual feature image is determined according to the initial image element points and the standard starting image element point.

In step 503, a trajectory of standard image element points of the actual feature image is predicted according to the state transition matrix, and trajectory image element points of the image element type in the RSL curved surface are extracted according to the trajectory of the standard image element point.

In step 504, a trajectory of actual image element points is determined according to the trajectory image element points.

In step 505, the actual feature image of the antenna to be adjusted is determined according to the starting image element point and the trajectory of the actual image element points.

In step 501, firstly, the standard starting image element point and the state transition matrix of the actual feature image are determined according to the standard feature image. It will be understood by those skilled in the art, the standard starting image element point is an ideal starting image element point, but not an actual image element point. The state transition matrix is an unchangeable intrinsic attribute of the standard feature image, and is mainly determined by a space between feature image element points in the radiation pattern, where the state transition matrix is used for predicting the trajectory of the image element points of the actual feature image.

In step 502, the initial image element points of the image element type in the RSL curved surface are extracted. In the specific implementation, the initial image element points may be extracted by scanning the RSL curved surface. Particularly, when a range of the image element points (including the range of the pitch angle and the range of the azimuth angle) and a scan mode (a fixed window or a sliding window) are determined, the extraction may be performed by performing one or more scan in a order from left to right, right to left, top to bottom, and top to bottom. Particularly, in the fixed window mode, the dispersion of the maximum values depends on a size of the window; in the sliding window mode, the dispersion of the maximum values depends on a step of the sliding window. In a case that the fixed window mode is adopted, windows may be partitioned by columns, where each column is determined as one window, or windows may be partitioned in rows, where each row is determined as one window. In the specific implementation, the implementation for extracting the initial image element points in the RSL curved surface is not specifically limited in the present embodiment.

Then, an initial point space between two neighboring initial image element points is acquired in a preset order, and a standard point space between two neighboring standard starting image element points is acquired in the preset order. In a case that the absolute value of the difference between the initial point space and the standard point space is less than a preset value, the two neighboring initial image element points are used as the actual starting image element point of the actual feature.

In the specific implementation, two or three initial image element points are generally acquired. The initial point space between two neighboring initial image element points may be acquired sequentially by starting from the first initial image element point. That is, the initial point space R1 between the first initial image element point and the second initial image element point is acquired. Then, the standard point space R2 between the first standard starting image element point and the second standard starting image element point is acquired. The first initial image element point and the second initial image element point are used as the actual starting image element point in a case that $|R1-R2|\leq\Delta R$.

Optionally, an initial image element point which belongs to the image element type in the RSL curved surface may continue to be extracted. The step of acquiring an initial point space between two neighboring initial image element points in a preset order, acquiring a standard point space between two neighboring standard starting image element points in the preset order, and the two neighboring initial image element points are used as the actual starting image element point of the actual feature in a case that the absolute value of the difference between the initial point space and the standard point space is less than a preset value, may be repeated until the number of the actual starting image element points reaches a preset number.

In step 503, the trajectory of the standard image element points of the actual feature image is predicted according to the state transition matrix, where the trajectory of the standard image element point is a theoretical trajectory of element points of the actual feature image, i.e., a theoretical arrangement of image element points. The tendency of arrangement of the element points of the actual feature image may be determined according to the trajectory of the standard image element point. Trajectory image element points belonging to the image element type and following the arrangement tendency in the RSL curved surface may be extracted by scanning according to the arrangement tendency. It will be understood by those skilled in the art, the extracted trajectory image element point may lie on the theoretical trajectory of element points, or may not lie on the theoretical trajectory of element points.

It will be understood by those skilled in the art, in the specific implementation, the step of predicting the trajectory of the standard image element points according to the current end point of the trajectory and the state transition matrix, determining and outputting the trajectory image element points, is required to be performed repeatedly, that is, the procedure of predicting the trajectory of the standard image element points, extracting the trajectory image element points and outputting the trajectory image element points is performed repeatedly until image element points at a boundary of the RSL curved surface are scanned and extracted.

Figure 6:
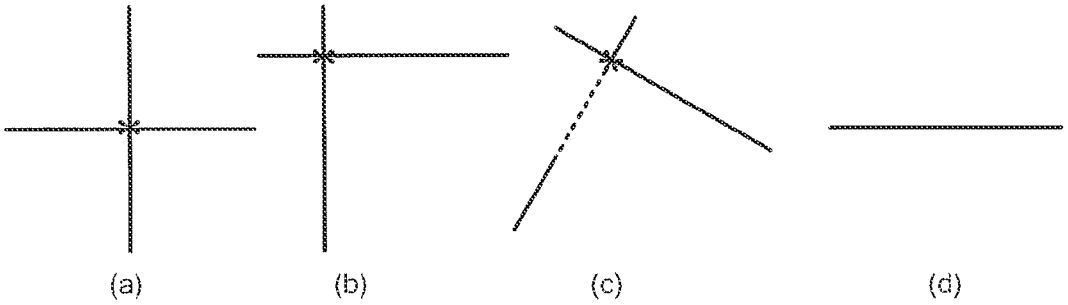
FIG. 6 is a schematic diagram of a typical situation for the actual feature image according to the disclosure.

In step 504 and step 505, the trajectory of the actual image element points is formed by connecting lines of the trajectory image element points, and the actual feature image of the antenna to be adjusted is formed by connecting lines of the starting image element points and the trajectory of the actual image element points. In a case that the image element is a local maximum value and the antenna to be adjusted is a panel antenna, the obtained actual feature image of the antenna to be adjusted may be as shown in FIG. 6, which is a schematic diagram of a typical situation for the actual feature image according to the present disclosure. The alignment direction of the main lobe may be determined according to the correspondence between the position of the main lobe in the standard feature image and the alignment direction of the main lobe in the actual feature image, i.e. the correspondence between FIG. 6 and FIG. 3B. In a case that the actual feature image takes forms of figures designated with (a) and (b) in FIG. 6, i.e., there is an intersecting point in the actual feature image, the intersecting point is determined as the alignment direction of the main lobe. In a case that the actual feature image takes the form of the figure designated with (c) in FIG. 6, one of the direct lines is extended and there is an intersecting point between the extending line and the other line, then the figure (c) is rotated to correspond to FIG. 3B, and the intersecting point on the extending line may be determined as the alignment direction of the main lobe. It will be understood by those skilled in the art, the actual feature image also includes a horizontal coordinate (not shown) which indicates the azimuth angle of the antenna and a longitudinal coordinate (not shown) which indicates the pitch angle of the antenna. The intersecting point of two direct lines corresponds to a corresponding azimuth angle and a corresponding pitch angle, and the direction corresponding to the azimuth angle and the pitch angle is the alignment direction of the main lobe. It will be understood by those skilled in the art, in determining the alignment direction of the main lobe, the alignment direction of the main lobe may have a high accuracy in a case that the alignment direction of the main lobe is determined according to the actual feature image. In a case that the actual feature image takes the form of the figure designated with (d) in FIG. 6, the alignment direction or tendency of the main lobe can not be determined only according to the actual feature image, and the tendency of the alignment direction of the main lobe needs to be determined in conjunction with a RSL curve corresponding to the feature image point. During the specific implementation, the alignment direction or the tendency of the alignment direction of the main lobe is determined according to a position of a local maximum value in the RSL curve.

According to the antenna alignment method provided in the embodiments of the disclosure, in the process of obtaining an actual feature image, an actual starting image element point of the actual feature image is determined according to initial image element points and standard starting image element points thus the actual starting image element points can be acquired rapidly and accurately, a trajectory of standard image element points of the actual feature image is predicted according to a state transition matrix, and a trajectory image element points of the image element type in the RSL curved surface are extracted according to the trajectory of the standard image element points. The trajectory image element points may be extracted according to the trajectory of the image element points, thus the efficiency and accuracy may be enhanced.

Figure 7:
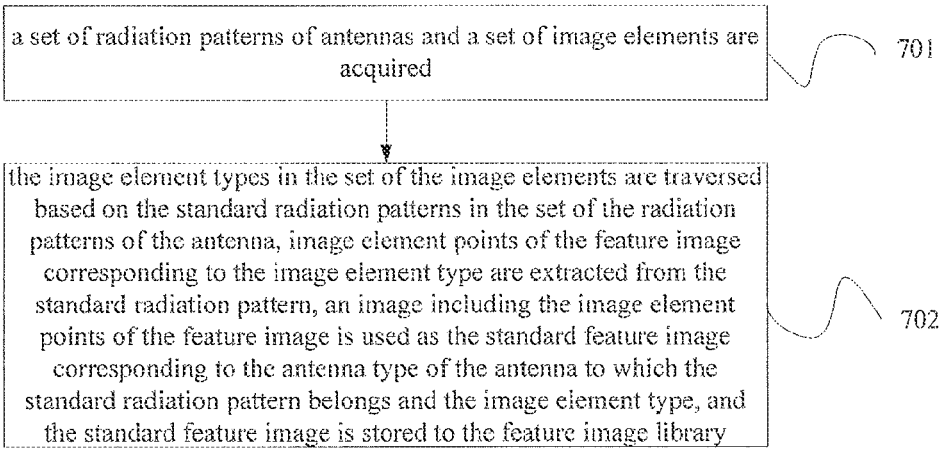
FIG. 7 is a flow chart of a process of establishing a feature image library according to the disclosure.

FIG. 7 is a flow chart of establishing a feature image library according to the present disclosure. The establishment of the feature image library is described in detail based on the above embodiments. It will be understood by those skilled in the art, the feature image library according to the present embodiment may be pre-established, and a standard feature image may be acquired from the feature image library directly when performing antenna alignment. The method according to the present embodiment includes the following steps 701 to 702.

In step 701, a set of radiation patterns of antennas and a set of image elements are acquired.

Particularly, the set of radiation patterns of the antennas includes standard radiation patterns of various types of antennas, and the set of image elements includes various image element types.

In step 702, the image element types in the set of the image elements are traversed based on the standard radiation patterns in the set of the radiation patterns of the antenna, image element points of the feature image corresponding to the image element type are extracted from the standard radiation pattern, an image including the image element points of the feature image is used as the standard feature image corresponding to the antenna type of the antenna to which the standard radiation pattern belongs and the image element type, and the standard feature image is stored to the feature image library.

In the specific implementation, a standard radiation pattern may be added to or deleted from the set of radiation patterns of the antenna periodically, and/or, a image element type may be added to or deleted from the set of image elements, thus the set of radiation patterns of the antenna and the set of image elements may be updated.

It will be understood by those skilled in the art, according to the present embodiment, the established feature image library includes two dimensions. One dimension indicates the antenna type corresponding to the standard radiation pattern, that is, different antennas have different standard feature images. The other dimension indicates the image element type, that is, in a case that the image element types are different, one antenna also has different standard feature images. In the specific application where the storage space is limited, the set of standard radiation patterns of the antenna only includes typical antennas.

All image element types are required to be traversed based on the standard radiation patterns. The image element points corresponding to the image element type are extracted from the standard radiation pattern, the image including the image element points is used as the standard feature image corresponding to the antenna type of the antenna to which the standard radiation pattern belongs and the image element type. For example, in a case that the set of radiation patterns of the antenna includes M standard radiation patterns, and the set of image elements includes N image element types, where M and N are integers greater than 0, the number of the standard feature images in the feature image library is $C_M^1 C_N^1 = M \times N$.

According to the present embodiment, the established feature image library includes standard feature images of different image element types corresponding to various types of antennas, thus a large amount of standard feature images may be provided for the actual antenna alignment operation, the standard feature image which matches the antenna to be adjusted and can be distinguished from ambient environment may be selected from the feature image library during antenna alignment, thus the accuracy of antenna alignment may be improved.

Figure 8:
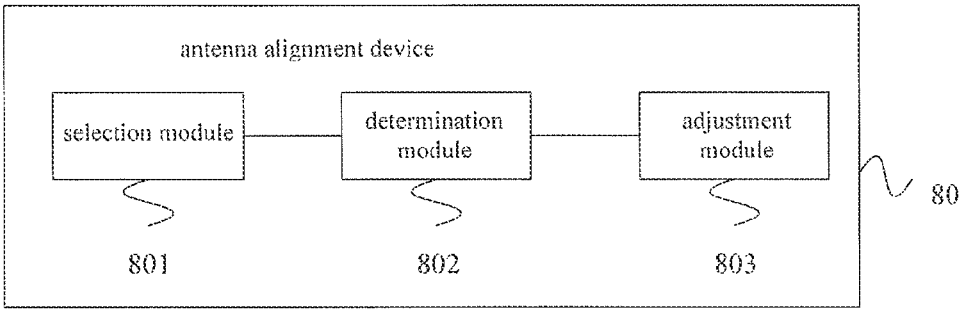
FIG. 8 is a schematic structural diagram of an antenna alignment device according to a first embodiment of the disclosure.

FIG. 8 is a schematic structural diagram of an antenna alignment device according to a first embodiment of the disclosure. As shown in FIG. 8, the antenna alignment device according to the present embodiment includes a selection module 801, a determination module 802 and an adjustment module 803.

Particularly, the selection module 801 is configured to acquire, according to an antenna type of an antenna to be adjusted and a pre-selected image element type, a standard feature image corresponding to the antenna type and the image element type from a feature image library, where the image element type is a feature attribute of data points in a Received Signal Level RSL curved surface or a radiation pattern of the antenna.

The determination module 802 is configured to determine an actual feature image of the antenna to be adjusted according to the standard feature image, where there is a correspondence between a position of a main lobe in the standard feature image and an alignment direction of a main lobe in the actual feature image.

The adjustment module 803 is configured to determine the alignment direction of the main lobe in the actual feature image according to the position of the main lobe in the standard feature image and the correspondence between the position of the main lobe in the standard feature image and the alignment direction of the main lobe in the actual feature image, and adjust the antenna to the alignment direction of the main lobe in the actual feature image.

The antenna alignment device according to the present embodiment is applicable for implementing the technical solution of the antenna alignment method according to the first embodiment of the disclosure. Its implementation principle and technical effect are similar, and descriptions thereof will be omitted herein.

Figure 9:
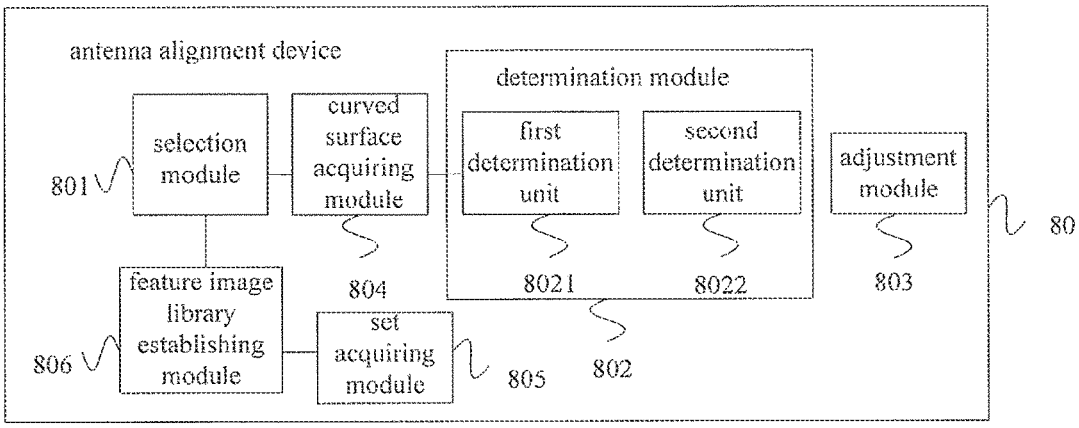
FIG. 9 is a schematic structural diagram of an antenna alignment device according to a second embodiment of the disclosure.

FIG. 9 is a schematic structural diagram of an antenna alignment device according to a second embodiment of the present disclosure. The present embodiment is implemented based on the embodiment described in FIG. 8. The detailed description is as follows.

Optionally, the device may further include:

a curved surface acquiring module 804, configured to acquire the RSL curved surface of the antenna to be adjusted before the actual feature image of the antenna to be adjusted is determined according to the standard feature image.

The determination module 802 is further configured to determine the actual feature image of the antenna to be adjusted according to the standard feature image, the RSL curved surface and the image element type.

Optionally, the determination module 802 may include:

a first determination unit 8021, configured to determine a standard starting image element point and a state transition matrix of the actual feature image according to the standard feature image, where the state transition matrix is used to predict a trajectory of image element points of the actual feature image; and a second determining unit 8022, configured to determine the actual feature image of the antenna to be adjusted according to image element points of the image element type in the RSL curved surface, the standard starting image element point, and the state transition matrix.

Optionally, the second determination unit 8022 may be further configured to:

extract initial image element points of the image element type in the RSL curved surface, and determine an actual starting image element point of the actual feature image according to the initial image element points and the standard starting image element points;

predict a trajectory of standard image element points of the actual feature image according to the state transition matrix, and extract a trajectory image element points of the image element type in the RSL curved surface according to the trajectory of the standard image element points;

determine a trajectory of actual image element points according to the trajectory image element points; and determine the actual feature image of the antenna to be adjusted according to the starting image element point and the trajectory of the actual image element points.

Optionally, the second determination unit 8022 may be further configured to:

acquire an initial point space between two neighboring initial image element points in a preset order, and acquire a standard point space between two neighboring standard starting image element points in the preset order; use the two neighboring initial image element points as the actual starting image element point of the actual feature in a case that the absolute value of the difference between the initial point space and the standard point space is less than a preset value.

Optionally, the alignment direction of the main lobe in the actual feature image may be an intersecting point of two straight lines in the actual feature image in a case that the image element is a local maximum value and the antenna to be adjusted is a panel antenna; and the alignment direction of the main lobe in the actual feature image may be the center of concentric circles in the actual feature image in a case that the image element type is a local minimum value and the antenna type of the antenna to be adjusted is a parabolic antenna.

Optionally, the device may further include a set acquiring module 805 and a feature image library establishing module 806.

The set acquiring module 805 is configured to, before acquiring the standard feature image corresponding to the antenna type and the image element type from the feature image library according to the antenna type of the antenna to be adjusted and the pre-selected image element type, acquire a set of radiation patterns of antennas and a set of image elements, where the set of radiation patterns of the antennas includes standard radiation patterns of various types of antennas, and the set of image elements includes various types of image elements.

The feature image library establishing module 806 is configured to traverse, based on the standard radiation patterns in the set of the radiation pattern of the antenna, the image elements in the set of the image element, extract an image element of the feature image corresponding to the image element type from the standard radiation pattern, use an image including the image element of the feature image as the standard feature image corresponding to the antenna type of the antenna to which the standard radiation pattern belongs and the image element type, and store the standard feature image to the feature image library.

The antenna alignment device is applicable for implementing technical solution of the antenna alignment method according to any of the embodiments of the disclosure. Its implementation principle and technical effect are similar, and descriptions thereof will be omitted herein.

Figure 10:
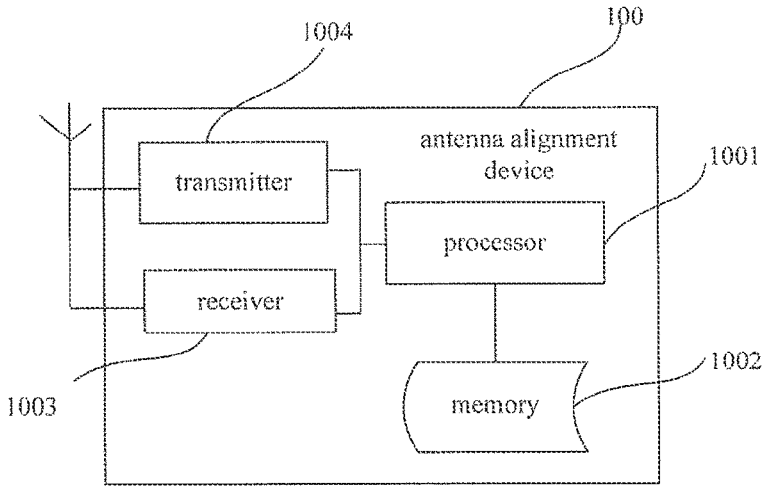
FIG. 10 is a schematic structural diagram of an antenna alignment device according to a third embodiment of the disclosure.

FIG. 10 is a schematic structural diagram of an antenna alignment device according to a third embodiment of the disclosure. As shown in FIG. 10, the antenna alignment device 100 according to the present embodiment includes a processor 101 and a memory 1002. The antenna alignment device 100 may further include a transmitter 1003 and a receiver 1004. The transmitter 1003 and the receiver 1004 may be connected with the processor 1001, where the transmitter 1003 is configured to transmit a signal via an antenna, the receiver 1004 is configured to receive a signal emitted from an antenna at the opposite end, and the memory 1002 is configured to store execution instructions. During operation of the antenna alignment device 100, the processor 1001 communicates with the memory 1002 and calls execution instructions in the memory 1002 for performing the following operations:

acquiring, according to an antenna type of an antenna to be adjusted and a pre-selected image element type, a standard feature image corresponding to the antenna type and the image element type from a feature image library, where the image element type is a feature attribute of data points in a Received Signal Level RSL curved surface or a radiation pattern of the antenna;

determining an actual feature image of the antenna to be adjusted according to the standard feature image, where there is a correspondence between a position of a main lobe in the standard feature image and an alignment direction of a main lobe in the actual feature image; and determining the alignment direction of the main lobe in the actual feature image according to the position of the main lobe in the standard feature image and the correspondence between the position of the main lobe in the standard feature image and the alignment direction of the main lobe in the actual feature image, and adjusting the antenna to be adjusted to the alignment direction of the main lobe in the actual feature image.

Optionally, before determining the actual feature image of the antenna to be adjusted according to the standard feature image, the method may further include:

acquiring the RSL curved surface of the antenna to be adjusted.

Determining the actual feature image of the antenna to be adjusted according to the standard feature image includes:

determining the actual feature image of the antenna to be adjusted according to the standard feature image, the RSL curved surface and the image element type.

Optionally, determining the actual feature image of the antenna to be adjusted according to the standard feature image, the RSL curved surface and the image element type may include:

determining a standard starting image element point and a state transition matrix of the actual feature image according to the standard feature image, where the state transition matrix is used to predict a trajectory of image element points of the actual feature image; and determining the actual feature image of the antenna to be adjusted according to image element points of the image element type in the RSL curved surface, the standard starting image element point, and the state transition matrix.

Optionally, determining the actual feature image of the antenna to be adjusted according to the image element point of the image element type in the RSL curved surface, the standard starting image element point, and the state transition matrix may include:

extracting initial image element points of the image element type in the RSL curved surface, and determining an actual starting image element point of the actual feature image according to the initial image element points and the standard starting image element point;

predicting a trajectory of standard image element points of the actual feature image according to the state transition matrix, and extracting trajectory image element points of the image element type in the RSL curved surface according to the trajectory of the standard image element points;

determining a trajectory of actual image element points according to the trajectory image element points; and determining the actual feature image of the antenna to be adjusted according to the starting image element point and the trajectory of the actual image element points.

Optionally, determining the actual starting image element point of the actual feature image according to the initial image element points and the standard starting image element points may include:

acquiring an initial point space between two neighboring initial image element points in a preset order, and acquiring a standard point space between two neighboring standard starting image element points in the preset order; using the two neighboring initial image element points as the actual starting image element point of the actual feature in a case that the absolute value of the difference between the initial point space and the standard point space is less than a preset value.

Optionally, the alignment direction of the main lobe in the actual feature image is an intersecting point of two straight lines in the actual feature image in a case that the image element is a local maximum value and the antenna to be adjusted is a panel antenna; and the alignment direction of the main lobe in the actual feature image is the center of concentric circles in the actual feature image in a case that the image element is a local minimum value and the antenna to be adjusted is a parabolic antenna.

Optionally, before acquiring the standard feature image corresponding to the antenna type and the image element type from the feature image library according to the antenna type of the antenna to be adjusted and the pre-selected image element type, the method may further include:

acquiring a set of radiation patterns of antennas and a set of image elements, where the set of radiation patterns of the antennas includes standard radiation patterns of various types of antennas, and the set of image elements includes various types of image elements; and traversing, based on the standard radiation patterns in the set of the radiation patterns of the antenna, the image element types in the set of the image elements, extracting an image element point of the feature image corresponding to the image element type from the standard radiation pattern, using an image including the image element point of the feature image as the standard feature image corresponding to the antenna type of the antenna to which the standard radiation pattern belongs and the image element type, and storing the standard feature image to the feature image library.

The antenna alignment device is applicable for implementing technical solution of the antenna alignment method according to any of the embodiments of the disclosure. Its implementation principle and technical effect are similar, and descriptions thereof will be omitted herein.

It should be understood that in the embodiments according to the present application, the equipments and methods disclosed may be realized in other ways. For example, the equipment embodiments described above are illustrative only, for example, division of the unit or module is only a logical function division, and other division manners are possible in practice, for example, multiple units or modules can be combined or integrated into another system, or some features can be omitted or not performed. Further, the coupling, direct coupling or communication connection among various members shown or discussed may be an indirect coupling or communication connection through interfaces, devices or modules electrically, mechanically or in other forms.

The module described as a separated component may be or may not be physically separated. A part shown in a module may be or may not be a physical unit, i.e. a part shown in a module may be located in one place or may be distributed to multiple network units. A part or all of the modules may be chosen as required to achieve the object of the present embodiment.

It should be understood by those skilled in the art that all or a part of the steps for implementing the above method embodiments may be performed by related hardware instructed by a program. The previously described program may be stored in a computer readable storage medium and when being executed may perform steps included in the above method embodiments. The previously described storage medium includes various mediums which may store a program code, such as ROM, RAM, a magnetic disk, or an optical disk which may store program code.

Finally, it should be noted that, the above embodiments are only description of technical solutions of the present invention, and not limitation thereto. Although the present disclosure is described in detail with reference to each of the aforementioned embodiments, those skilled in the art will readily appreciate that many modifications are possible in the technical solutions described in the above embodiments, or all or some of the technical features may be substituted by equivalents. The corresponding technical solution would not depart from the scope of the technical solution of the embodiments of the present disclosure by these modifications and alternations.

What is claimed is:

1. An antenna alignment method, comprising:

acquiring, according to an antenna type of an antenna to be adjusted and a pre-selected image element type, a first feature image corresponding to the antenna type and the image element type from a feature image library, wherein the image element type is a feature attribute of data points in a Received Signal Level (RSL) curved surface or a radiation pattern of the antenna;

acquiring the RSL curved surface of the antenna to be adjusted;

determining an actual feature image of the antenna to be adjusted according to the first feature image, the RSL curved surface, and the image element type, wherein there is a correspondence between a position of a main lobe in the first feature image and an alignment direction of a main lobe in the actual feature image; and determining the alignment direction of the main lobe in the actual feature image according to the position of the main lobe in the first feature image and the correspondence between the position of the main lobe in the first feature image and the alignment direction of the main lobe in the actual feature image, and adjusting the antenna to the alignment direction of the main lobe in the actual feature image;

wherein determining the actual feature image of the antenna to be adjusted according to the first feature image, the RSL curved surface, and the image element type comprises:

determining a first starting image element point and a state transition matrix of the actual feature image according to the first feature image, wherein the state transition matrix predicts a trajectory of image element points of the actual feature image; and determining the actual feature image of the antenna to be adjusted according to image element points of the image element type in the RSL curved surface, the first starting image element point, and the state transition matrix.

2. The method according to claim 1, wherein determining the actual feature image of the antenna to be adjusted according to the image element points of the image element type in the RSL curved surface, the first starting image element point, and the state transition matrix comprises:

extracting initial image element points of the image element type in the RSL curved surface, and determining an actual starting image element point of the actual feature image according to the initial image element points and the first starting image element point;

predicting a trajectory of first image element points of the actual feature image according to the state transition matrix, and extracting trajectory image element points of the image element type in the RSL curved surface according to the trajectory of the first image element points;

determining a trajectory of actual image element points according to the trajectory image element points; and determining the actual feature image of the antenna to be adjusted according to the starting image element point and the trajectory of the actual image element points.

3. The method according to claim 2, wherein determining the actual starting image element point of the actual feature image according to the initial image element points and the first starting image element points comprises:

acquiring an initial point space between two neighboring initial image element points in a preset order;

acquiring a first point space between two neighboring first starting image element points in the preset order; and using the two neighboring initial image element points as the actual starting image element point of the actual feature in a case that an absolute value of a difference between the initial point space and the first point space is less than a preset value.

4. The method according to claim 1, wherein the alignment direction of the main lobe in the actual feature image is an intersecting point of two straight lines in the actual feature image in a case that the image element is a local maximum value and the antenna to be adjusted is a panel antenna; and the alignment direction of the main lobe in the actual feature image is a center of concentric circles in the actual feature image in a case that the image element is a local minimum value and the antenna to be adjusted is a parabolic antenna.

5. The method according to claim 1, wherein, before acquiring the first feature image corresponding to the antenna type and the image element type from the feature image library according to the antenna type of the antenna to be adjusted and the pre-selected image element type, the method further comprises:

acquiring a set of radiation patterns of antennas and a set of image elements, wherein the set of radiation patterns of the antennas comprises first radiation patterns of various types of antennas, and the set of image elements comprises various types of image elements; and traversing, based on the first radiation patterns in the set of the radiation patterns of the antenna, the image element types in the set of the image elements, extracting an image element point of a feature image corresponding to the image element type from the first radiation pattern, using an image comprising the image element point of the feature image as the first feature image corresponding to the antenna type of the antenna to which the first radiation pattern belongs and the image element type, and storing the first feature image to the feature image library.

6. An antenna alignment device, comprising:

one or more processors; and a non-transitory memory storing a plurality of processor-executable instructions that, when executed by the one or more processors, cause the antenna alignment device to:

acquire, according to an antenna type of an antenna to be adjusted and a pre-selected image element type, a first feature image corresponding to the antenna type and the image element type from a feature image library, wherein the image element type is a feature attribute of data points in a Received Signal Level (RSL) curved surface or a radiation pattern of the antenna;

acquire the RSL curved surface of the antenna to be adjusted;

determine an actual feature image of the antenna to be adjusted according to the first feature image, the RSL curved surface, and the image element type, wherein there is a correspondence between a position of a main lobe in the first feature image and an alignment direction of a main lobe in the actual feature image; and determine the alignment direction of the main lobe in the actual feature image according to the position of the main lobe in the first feature image and the correspondence between the position of the main lobe in the first feature image and the alignment direction of the main lobe in the actual feature image, and adjust the antenna to the alignment direction of the main lobe in the actual feature image;

wherein determining the actual feature image of the antenna to be adjusted according to the first feature image, the RSL curved surface, and the image element type comprises:

determining a first starting image element point and a state transition matrix of the actual feature image according to the first feature image, wherein the state transition matrix predicts a trajectory of image element points of the actual feature image; and determining the actual feature image of the antenna to be adjusted according to image element points of the image element type in the RSL curved surface, the first starting image element point, and the state transition matrix.

7. The device according to claim 6, wherein determining the actual feature image of the antenna to be adjusted according to the image element points of the image element type in the RSL curved surface, the first starting image element point, and the state transition matrix comprises:

extracting initial image element points of the image element type in the RSL curved surface, and determining an actual starting image element point of the actual feature image according to the initial image element points and the first starting image element point;

predicting a trajectory of first image element points of the actual feature image according to the state transition matrix, and extract a trajectory image element points of the image element type in the RSL curved surface according to the trajectory of the first image element points;

determining a trajectory of actual image element points according to the trajectory image element points; and determining the actual feature image of the antenna to be adjusted according to the starting image element point and the trajectory of the actual image element points.

8. The device according to claim 7, wherein determining the actual starting image element point of the actual feature image according to the initial image element points and the first starting image element points comprises:

acquiring an initial point space between two neighboring initial image element points in a preset order;

acquiring a first point space between two neighboring first starting image element points in the preset order; and using the two neighboring initial image element points as the actual starting image element point of the actual feature in a case that an absolute value of a difference between the initial point space and the first point space is less than a preset value.

9. The device according to claim 6, wherein the alignment direction of the main lobe in the actual feature image is an intersecting point of two straight lines in the actual feature image in a case that the image element is a local maximum value and the antenna to be adjusted is a panel antenna; and the alignment direction of the main lobe in the actual feature image is a center of concentric circles in the actual feature image in a case that the image element is a local minimum value and the antenna to be adjusted is a parabolic antenna.

10. The device according to claim 6, wherein, before acquiring the first feature image corresponding to the antenna type and the image element type from the feature image library according to the antenna type of the antenna to be adjusted and the pre-selected image element type, the instructions further cause the antenna alignment device to:

acquire a set of radiation patterns of antennas and a set of image elements, wherein the set of radiation patterns of the antennas comprises first radiation patterns of various types of antennas, and the set of image elements comprises various types of image elements; and traverse, based on the first radiation patterns in the set of the radiation pattern of the antenna, the image elements in the set of the image element, extract an image element of a feature image corresponding to the image element type from the first radiation pattern, use an image comprising the image element of the feature image as the first feature image corresponding to the antenna type of the antenna to which the first radiation pattern belongs and the image element type, and store the first feature image to the feature image library.

* * * * *